US007387467B2

(12) United States Patent
Kelty

(10) Patent No.: US 7,387,467 B2
(45) Date of Patent: Jun. 17, 2008

(54) WATER COLLECTION SYSTEM

(76) Inventor: Charles F. Kelty, 8 Water Garden Way, Santa Fe, NM (US) 87508

( * ) Notice: Subject to any disclaimer, the term of this patent is extended or adjusted under 35 U.S.C. 154(b) by 266 days.

(21) Appl. No.: 11/315,910

(22) Filed: Dec. 22, 2005

(65) Prior Publication Data

US 2007/0147960 A1 Jun. 28, 2007

(51) Int. Cl.
*E02B 11/00* (2006.01)
*E02B 13/00* (2006.01)

(52) U.S. Cl. ..... 405/36; 405/43; 405/53; 220/567.1

(58) Field of Classification Search ..... 405/36, 405/41, 43–45, 52, 53, 55; 220/567.1
See application file for complete search history.

(56) References Cited

U.S. PATENT DOCUMENTS 697,954 A * 4/1902 Stewart ..... 220/567.1
2,482,870 A * 9/1949 Price ..... 210/542
2,595,923 A * 5/1952 Carslon ..... 210/542
3,097,166 A * 7/1963 Monson ..... 210/170.08
3,240,343 A * 3/1966 Werner ..... 210/256
3,784,012 A * 1/1974 Carlson ..... 210/170.08
3,817,864 A * 6/1974 Carslon et al. ..... 210/170.08
3,908,385 A 9/1975 Daniel et al.
4,338,191 A * 7/1982 Jordan ..... 210/199
4,881,846 A 11/1989 Burkstaller
4,983,069 A * 1/1991 Florence ..... 405/43
5,852,901 A * 12/1998 Meyers ..... 52/20
6,095,718 A 8/2000 Bohnhoff
6,328,890 B1 12/2001 Thibault
7,178,677 B1 * 2/2007 McKinney ..... 210/513
2005/0011144 A1 1/2005 Laine
2005/0098488 A1 5/2005 Kelly et al.

FOREIGN PATENT DOCUMENTS

GB 1468761 3/1977
JP 04225897 A * 8/1992
JP 2003311284 A * 11/2003

* cited by examiner

*Primary Examiner*—Frederick L Lagman

(57) ABSTRACT

A water collection system.

16 Claims, 15 Drawing Sheets

WATER COLLECTION SYSTEM

BACKGROUND OF THE INVENTION

1. Field of the Invention (Technical Field)

The present invention relates to a kit for construction of a water conservation system including a chamber for water collection and distribution.

2. Background

Conservation of water is a highly desirable practice in the United States, particularly in arid regions. In many applications utilizing water, it is desirable to collect the water for subsequent controlled distribution. In one application, for example, the water is used in a decorative water system, referred to in the landscaping trade as a "water feature" such as a garden waterfall, water fountain, or similar structure where the water provides aesthetic display. In such systems water is pumped to an elevated height and allowed to flow by gravity into a collection chamber where it is used in various ways. For example, the chamber may function as a pump well, comprising a pre-constructed water impermeable housing installed in a sub-surface excavation within a natural or man-made aquifer. The man-made aquifer may comprise a bed of granular material such as gravel contained in a below surface cavity. A system of this type is shown in U.S. Pub. No. US2005/0098488.

In general, a chamber may serve as a depot for water collection, water level maintenance mechanisms and water pumping equipment.

In another application, natural rainwater that drains from, for example, a roof of a building may be directed by various means well known to those in the art, such as gutters and drain pipes, to a collection point. A chamber is deployed in a cavity of a natural or man-made aquifer to collect the drained water for subsequent controlled distribution. The distribution may comprise the simple slow flow of the water throughout the aquifer where it may be used to provide water to vegetation or it may be piped to another location.

The term "aquifer" is used to refer to a rock formation or group of rock formations containing granular material, such as gravel. The word "chamber" is used to refer to a reservoir, container, enclosure, housing, compartment, or other enclosed space of any three dimensional shape, such a cylinder, box, cone, sphere or the like and constructed of any material such as plastic, metal, wood, or other relatively water impermeable material. The word "water" refers to $H_2O$ in liquid form usually containing relatively small quantities of minute solid material; water may be, but is not necessarily, potable. "Controlled distribution" refers to storage and delivery of water by a system other than natural dissipation, such as percolation into the subsurface, evaporation, or uncontrolled runoff, to thereby permit re-application of the water in a higher use.

BRIEF SUMMARY OF THE INVENTION

The present invention relates to water conservation through the use of a chamber located in a cavity in an aquifer for the collection of water. While the chamber may have a variety of three-dimensional shapes, a generally cylindrical housing is shown in the preferred embodiment. The chamber may be shipped as an assemblage in a kit to an installer or ultimate customer from a remote location and it is desirable to reduce the size or bulk of the chamber for purposes of minimizing shipping expenses, handling, etc. The housing may therefore be comprised of several cooperating members which are shipped, in nested fashion, and are assembled on-site to form a complete chamber with water impermeable walls. The cooperating members are joined at a substantially water impermeable seam between adjoining walls. The upper end of the chamber defines a top opening for engagement with a lid. The chamber may have a bottom. The lower portion of the chamber has at least one opening and in the preferred embodiment a plurality of openings defining a water permeable portion for permitting water to flow out of the chamber while preventing the aquifer granular material from entering through the openings thereby controlling the flow of the water out of the chamber into the aquifer. The kit may include, when the chamber is used in connection with a water feature, such as waterfall or pond, a pump for recycling water from the chamber through an elevated point of discharge to provide an aesthetic display.

In a preferred embodiment, the chamber is shaped like the upper portion of a bottle including a neck, a cylindrical body portion, and a shoulder portion.

The chamber may have a plurality of knockouts to accommodate tubes, pipes, hoses, or similar water carrying elongated structures which may receive or discharge water from or to a remote location. A lid may be selectively lockable to the top opening of the chamber. The chamber segments or members may be snapped together with suitable latch mechanisms. Water distribution from the chamber may be enhanced through horizontal pipes that connect into the lower portion of the chamber allowing water to flow into the pipes where it is discharged through small openings over a larger area of the aquifer. The kit may also include an extension which mounts on the top opening of the chamber so as to increase the vertical height and volumetric capacity of the chamber.

DETAILED DESCRIPTION OF A PREFERRED EMBODIMENT

Figure 1:
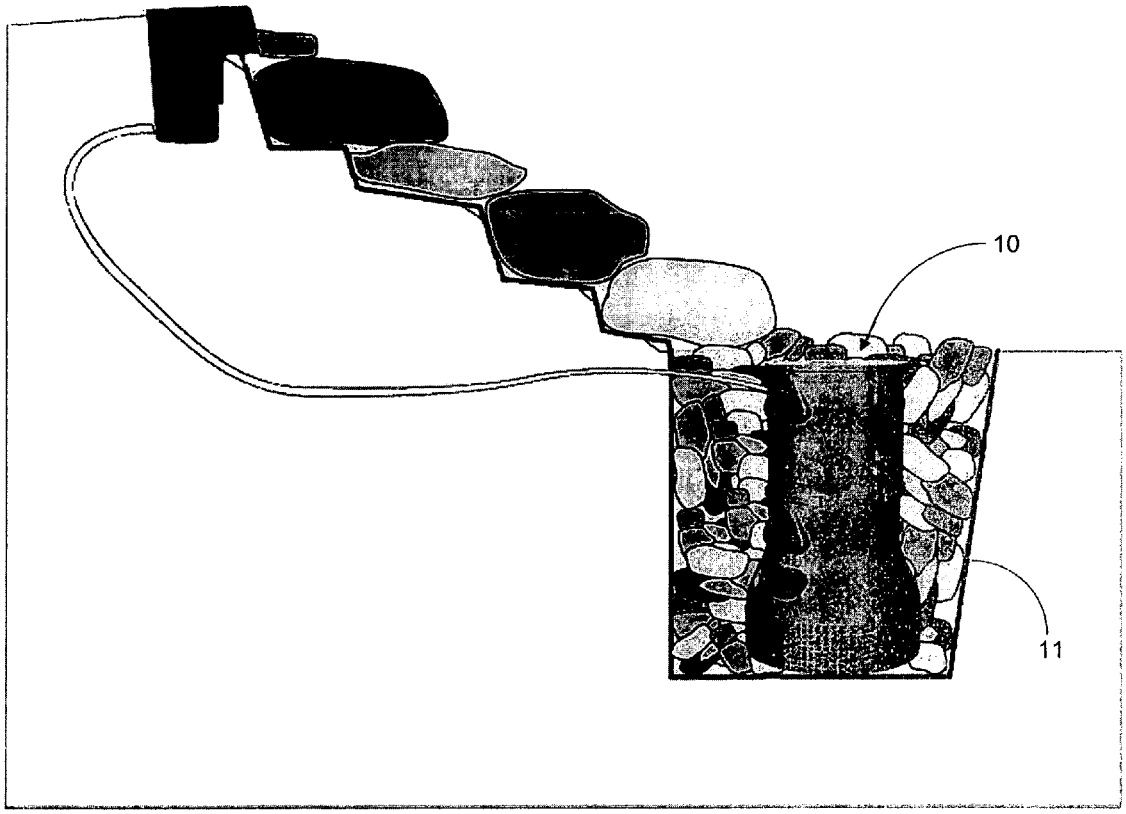
FIG. 1 is a diagrammatic cut-away view of a water collection system installed in a landscape waterfall feature.

The invention may comprise a kit that includes all the necessary components for constructing a water collection and distribution system for installation in a natural or man-made aquifer for the purpose of the collection of water for subsequent controlled distribution of such water. Depending upon the particular application, the kit will include a chamber 10, and may also include a pump, for example, where the water in the chamber that is collected is reapplied by moving the water to an elevated location from which it may enter into a water feature such as a waterfall or a pool. A typical waterfall installation is shown in FIG. 1. The aquifer is formed in a conventional manner such as by creating an excavation 11 in the soil into which a water impermeable membrane is placed on the surface of the soil and the excavation is then filled with granular material, such as gravel. The granular material may be of different sizes ranging from small pebbles to larger rocks, as is well known in the art. The aquifer may be constructed of various natural or man made materials and laid out in a variety of shapes, depths, and volumes. The chamber 10 of the present invention is placed in the excavation 11 preferably prior to filling the excavation with gravel, such that the top of the chamber is at approximate ground level (grade) permitting entry through a top opening for maintaining, cleaning, and accessing a pump or other equipment, tools, or the like located in the chamber.

Figure 2:
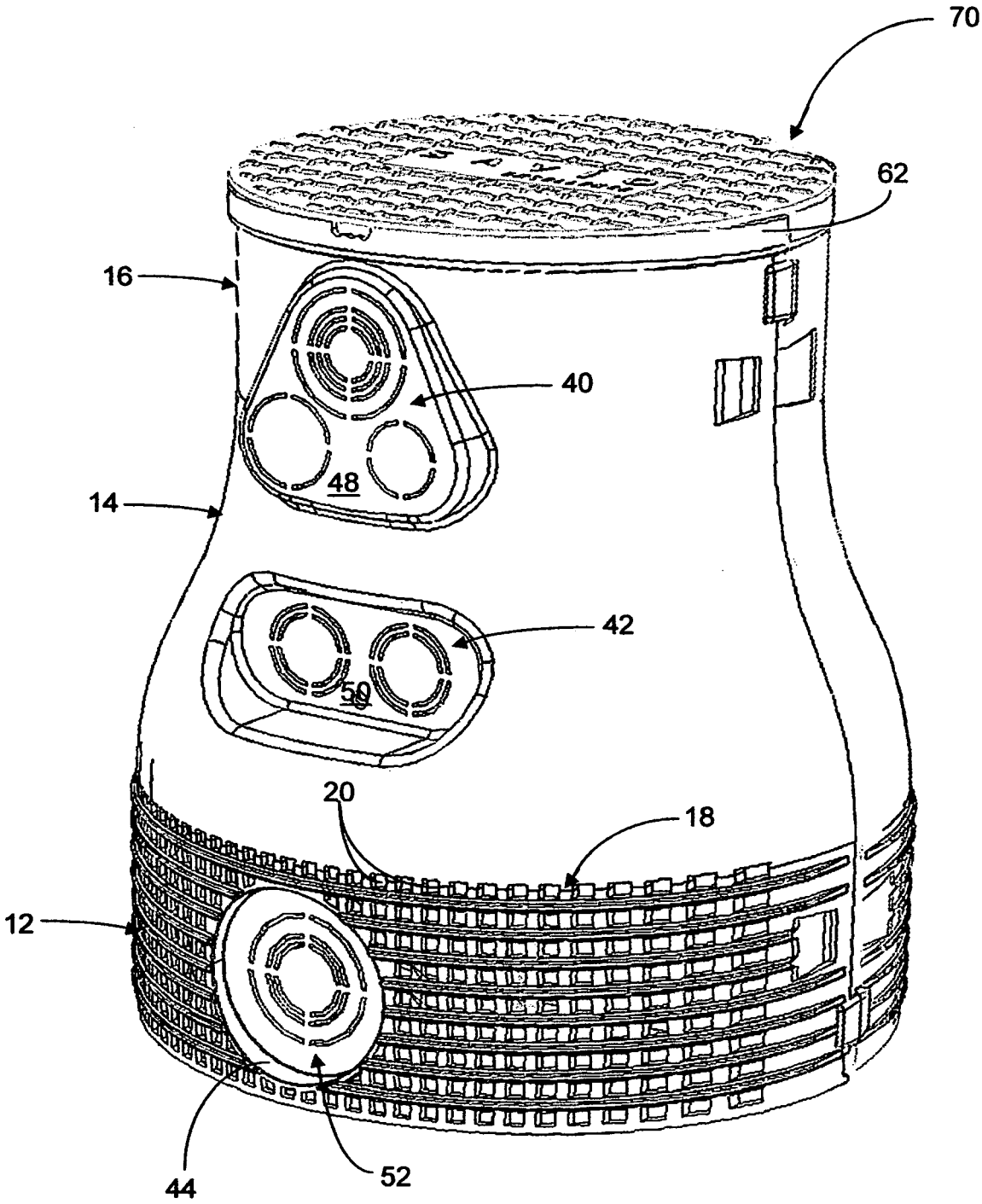
FIG. 2 is a perspective view of a preferred embodiment of a chamber for the collection of water.

As seen in FIG. 2, chamber 10 includes a lower cylindrical portion, 12, a transition, intermediate or shoulder portion 14, and a neck or smaller diameter cylindrical portion 16. The overall shape of the chamber 10 is thus similar to a squat bottle or the upper section of a typical glass bottle. The transition portion 14 may be curved as shown in FIG. 2, or may be a frusto-conical shape interconnecting the smaller diameter upper portion or neck 16 with the lower body portion 12. The shape of the preferred embodiment of the chamber has several bottle-like advantages: the opening is smaller than if the chamber was a perfect cylinder having the diameter of the body portion thereby reducing the size of the lid; the smaller lid provides greater safety and the smaller neck is more structurally stable; the capacity of the chamber is greater than if the entire body was the diameter of the neck; the large diameter body provides a large area for water distribution.

Figure 5:
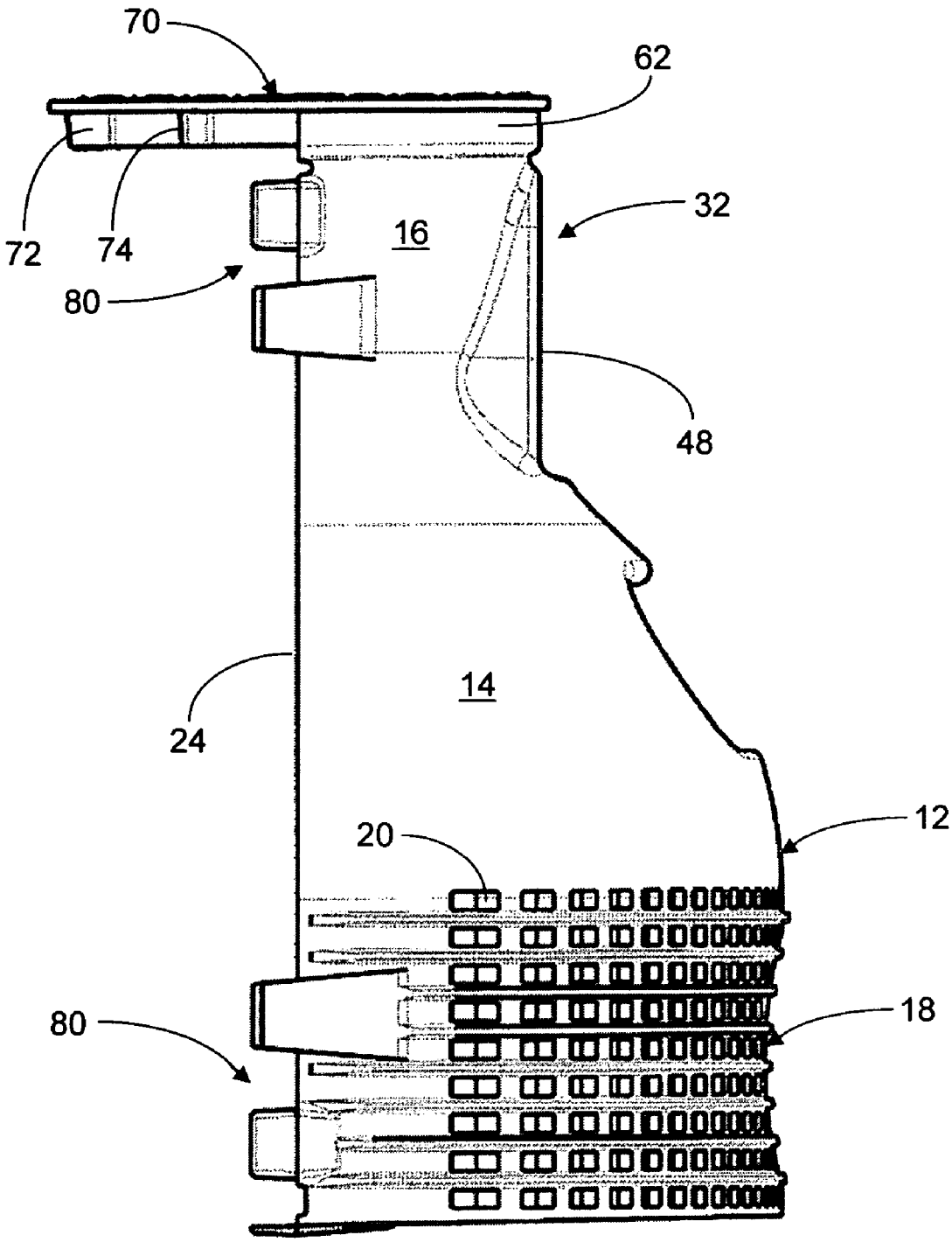
FIG. 5 is a side elevation cut-away view of the member shown in FIG. 4 with a lid.
Figure 6:
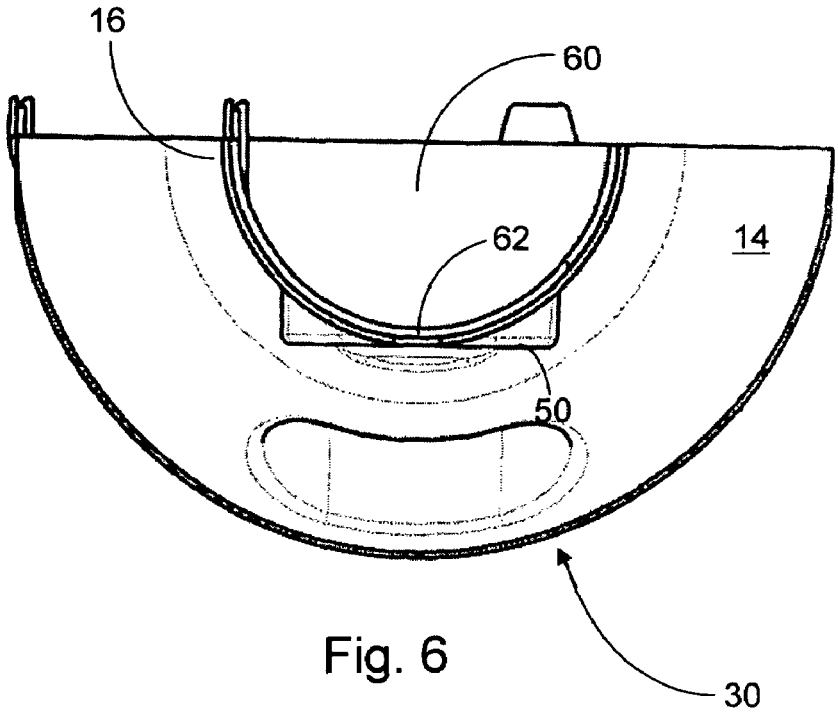
FIG. 6 is a top view of the member shown in FIG. 5, without the lid.
Figure 7:
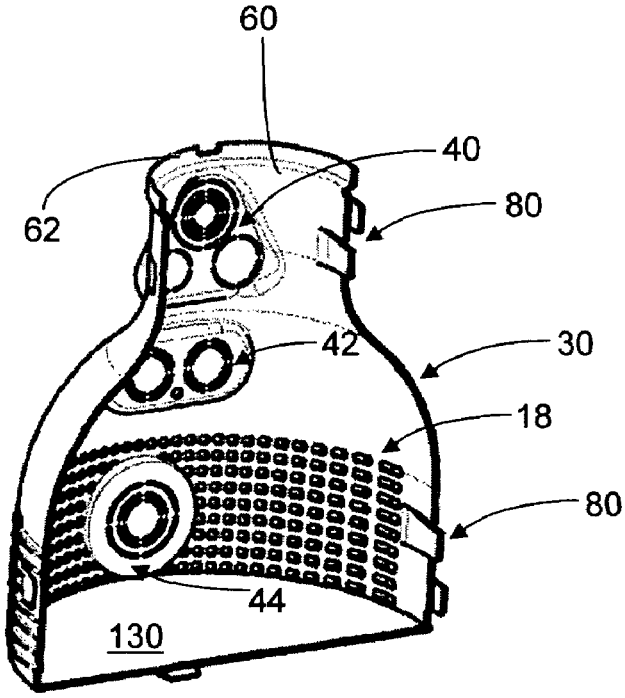
FIG. 7 is an interior view of the member shown in FIG. 5.

The lower body portion 12 is provided with a water permeable area 18 for discharging water collected in chamber 10 into the aquifer. In the preferred embodiment, the water permeable area comprises a plurality of holes 20 in the chamber wall as seen best in FIGS. 3 and 5; it extends generally from the bottom of the chamber up to the transition portion 14 though it will be understood that the water permeable area may be of variable height but preferably near the bottom of the body portion 12. It will also been seen from FIG. 3 that the holes 20 may extend substantially around the circumference of the lower portion 12 of chamber 10 excepting the area immediately adjacent the member edges as explained below. Of course, the holes 20 may be disposed over less than the substantially circumferential area depending upon the application of chamber 10. It will be readily appreciated by those having ordinary skill in the art that the same effect as holes 20 within the wall of the lower portion 12 of chamber 10 may be provided in a variety of ways such as a single opening covered by a screen, mesh, or other water permeable member. The holes may be of various shapes and sizes and arranged in various patterns, for example as a series of vertical slots. Other schemes for water discharge may include a bottom portion 12 made of a water semi-permeable material. One design consideration for the water permeable area is the rate of flow of water out of the chamber to suit the application.

The size of the holes should be roughly smaller than the minimum size of the granular material that comprises the aquifer. In this manner, water may pass from the interior of the chamber 10 into the aquifer but the granular material may not enter through the holes 20 so as to fill the bottom portion 12 of the chamber 10. The one way passage effect may also be attained by surrounding the adjacent lower portion 12 of chamber 10 with larger size materials such as rocks. This will also prevent the aquifer material from clogging the openings. It is desirable to prevent the gravel from filling the bottom of the chamber 10 since that displaces the volume otherwise available for collected water and could impede the flow of water out of chamber 10 into the aquifer.

Figure 3:
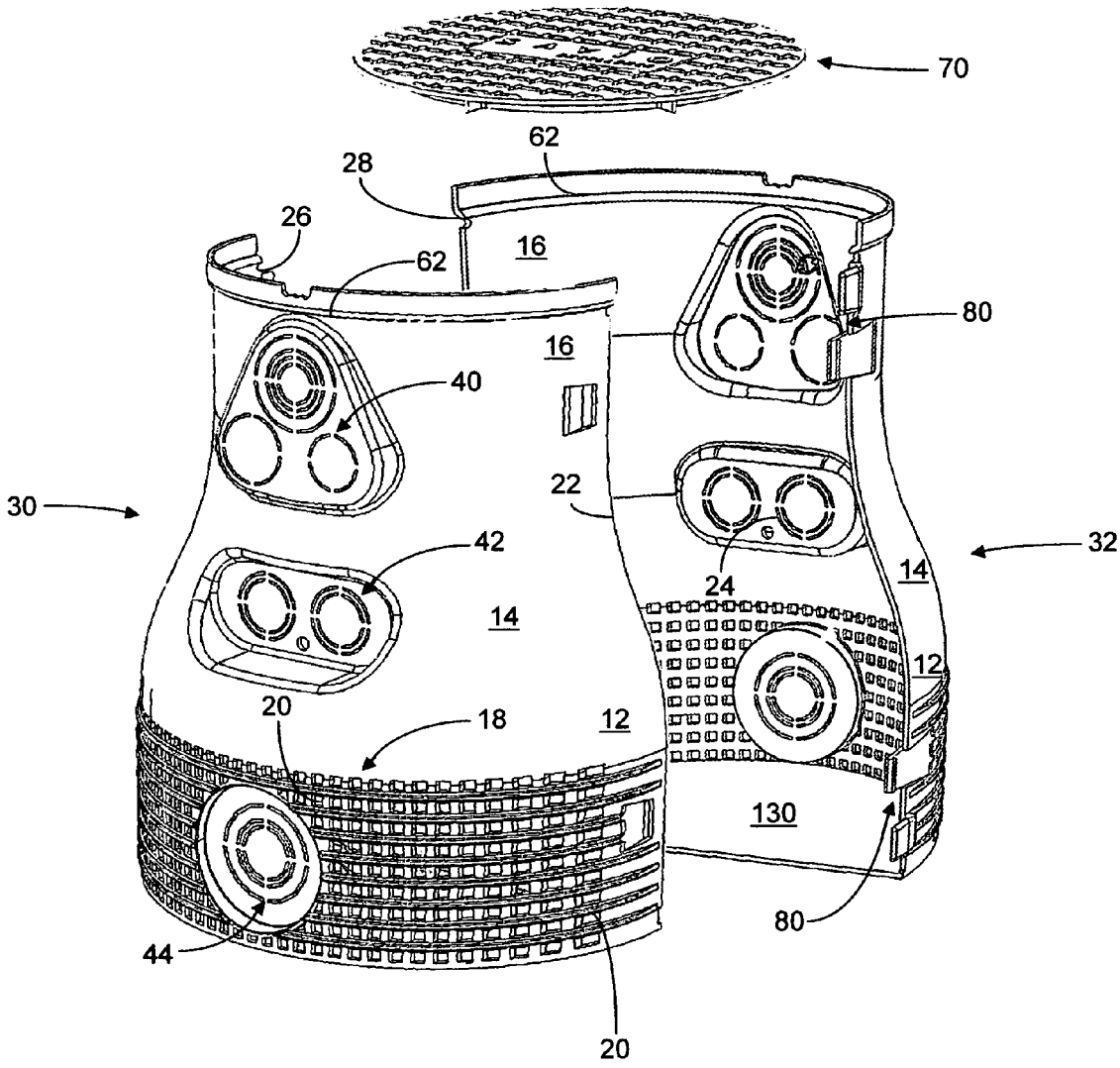
FIG. 3 is a perspective view of the chamber shown in FIG. 2 showing the cooperating members of the chamber separated prior to assembly.
Figure 4:
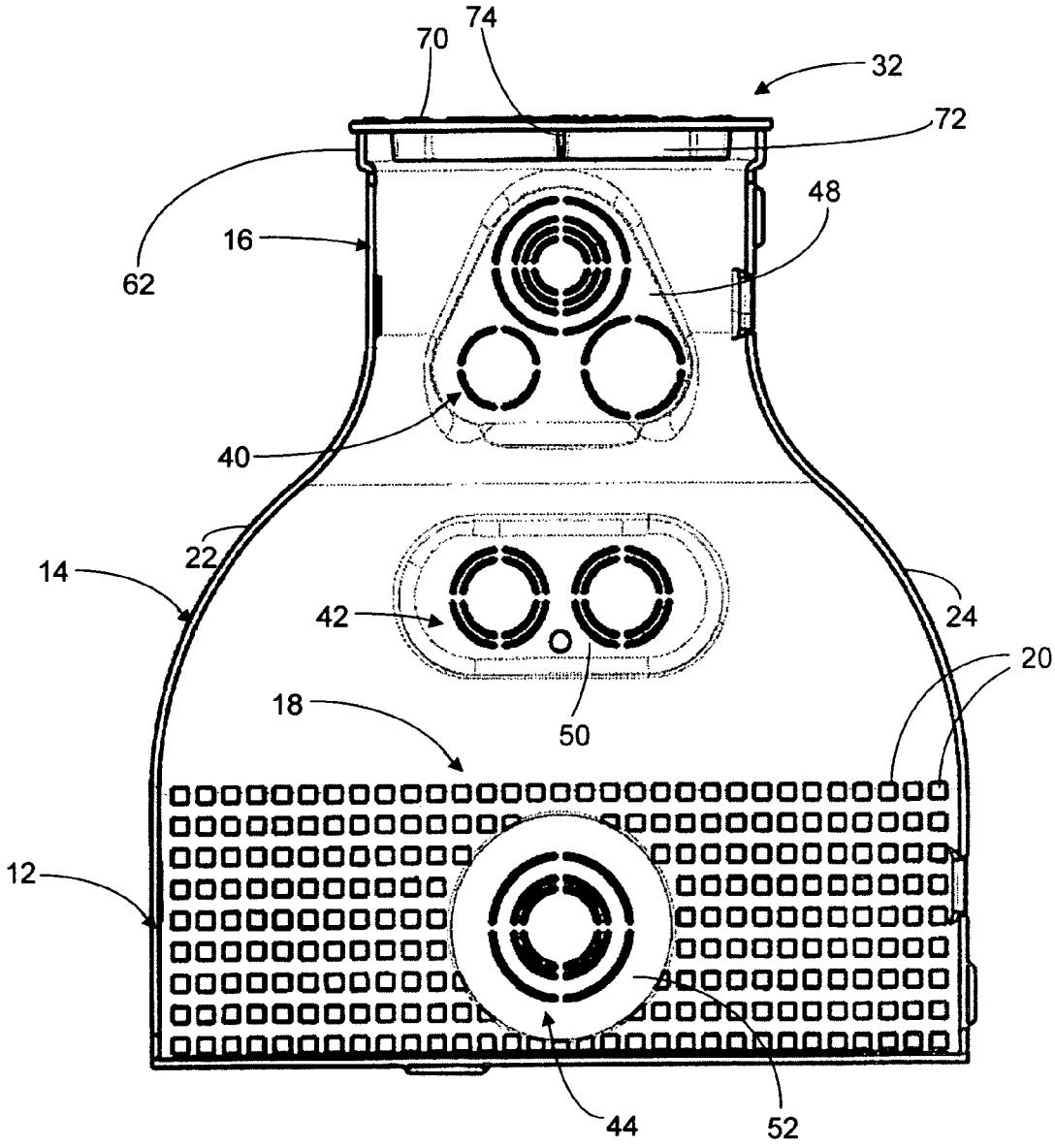
FIG. 4 is a side elevation cut-away view of one member forming the chamber of FIG. 2.
Figure 8:
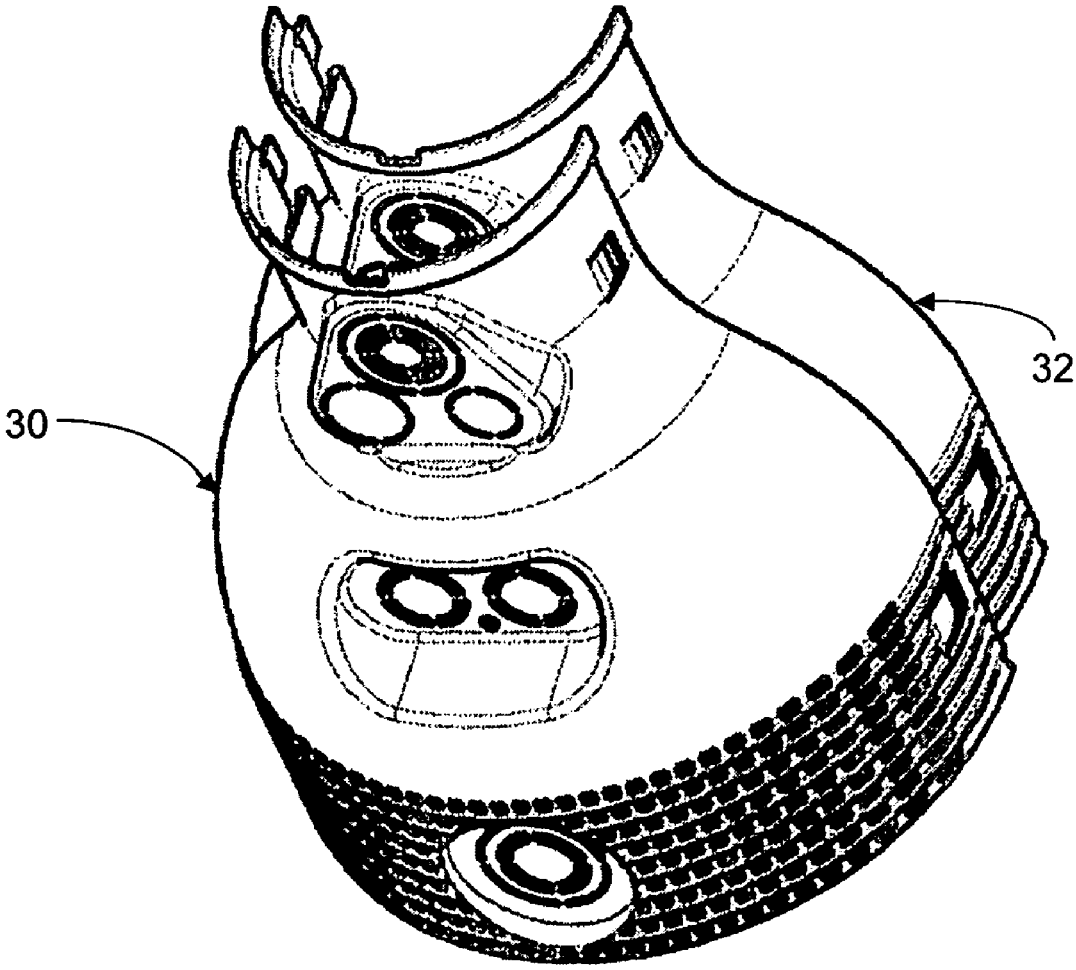
FIG. 8 is a perspective view of chamber members of the preferred embodiment shown nested in preparation for shipment.
Figure 9:
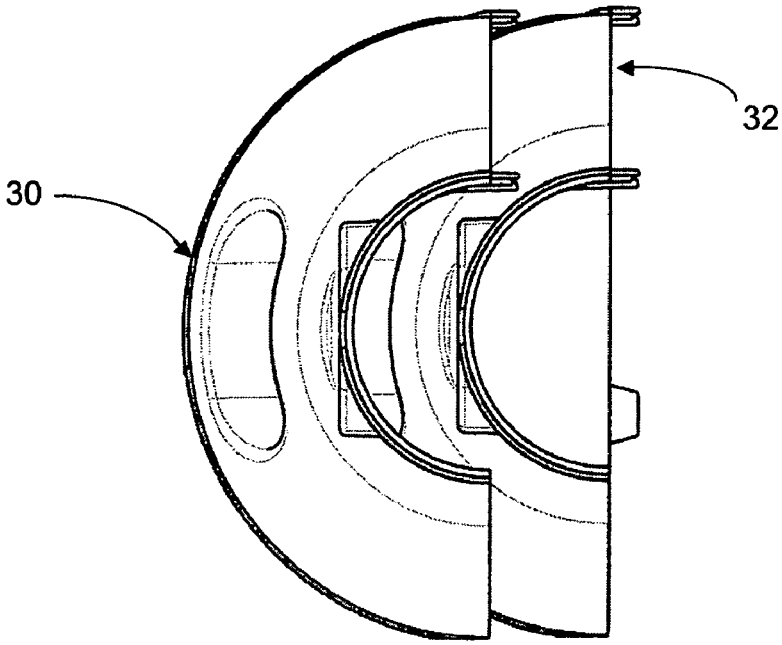
FIG. 9 is a top view of the two chamber members shown in FIG. 8.
Figure 10:
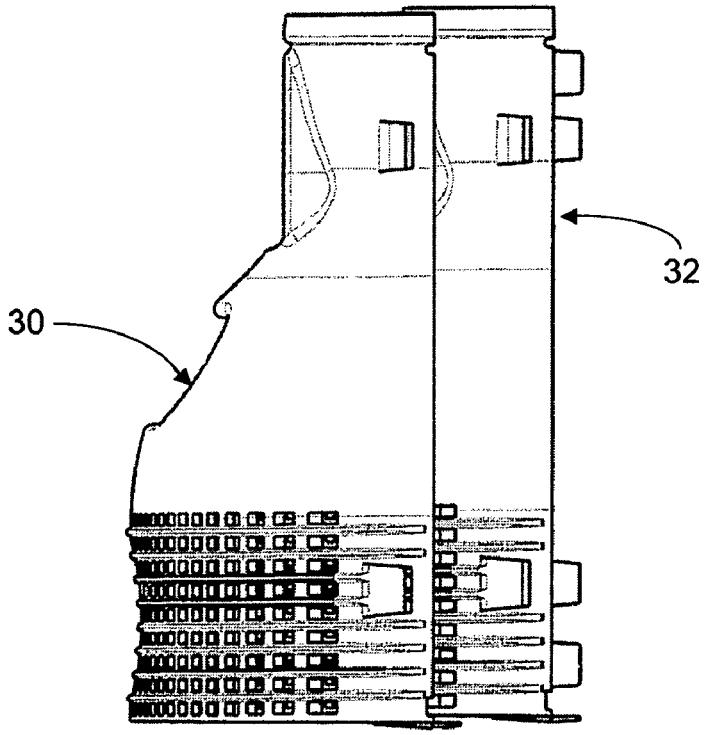
FIG. 10 is a side view of the two chamber members shown in FIG. 8.

As seen best in FIG. 3, as well as in FIGS. 4-7, the chamber 10 in the preferred embodiment comprises two separate segment members formed by dividing the chamber 10 along a vertical plane so as to define two mating halves with adjoining vertical edges 22, 24 and 26, 28. In the preferred embodiment, the segment members 30, 32 are semi-cylindrical although it will be appreciated by those having ordinary skill in the art that the cylinder could be segmented into three or more arcuate members, i.e. arcuate segments of a generally cylindrical shape with adjoining edges cooperating during assembly so as to complete a three-dimensional water collection chamber. One of the advantages of constructing the chamber 10 with two or more members is in connection with shipment and sale of the chamber 10 as part of a kit to be assembled and installed at the site of the water feature or other application. Attention is drawn to FIGS. 8-10 where it is shown that the segment members 30, 32 may be nested so as to reduce the volume of the chamber during shipment and inventorying thereby reducing the cost. By nesting the segment members the dimension of a carton or box in which the kit is shipped may be reduced in size in one dimension by approximately 25%.

Each of the arcuate segment members 30, 32 is provided with knock-out openings of an appropriate size in the walls of the segments for facilitating the connection of a pipe, tube, hose or similar water-carrying elongated member through such opening. To accommodate the various applications to which the water collection chamber 10 may be employed, the knock-out openings are of various sizes and are formed by circular score lines, or discontinuous circumferential perforations. In the preferred embodiment, in the neck or upper portion 16 there is provided three knock-out openings of various sizes indicated generally at 40. The three openings 40 are arranged in a triangle and the upper most opening is perforated such that it may accommodate four different diameter sizes of pipe. The central portion includes knock-out openings 42 arranged horizontally, each accommodating tubes of two different sizes. In the lower portion 12 of the chamber there is formed an additional knock-out opening which may accommodate pipes of three sizes. As seen best in FIG. 3, the knock-out openings 40, 42 and 44 are formed on generally flat surfaces such as surface 48 to accommodate knock-out openings 40 which is proud of the diameter of neck portion 16, an inset flattened surface 50 in which knock-out openings 42 are formed, and an inset flat surface 52 in which knock-out openings 44 are formed. It will also be seen from FIG. 3, that both segments 30 and 32 have identical knock-out openings and accompanying flat surfaces. The knock-out openings may accommodate a variety of purposes such as an inlet pipe, a discharge pipe, access openings for equipment within the chamber, and in the case of knock-out openings 44, to accommodate horizontally extending pipes with a plurality of openings so as to further distribute the water into portions of the aquifer that are not immediately adjacent to the holes 20 in the lower portion 12 of chamber 10. It will be appreciated that the number, size, location, shapes and technique for defining the openings by weakening an outline for an opening in the chamber wall are all well known to those skilled in the art. The advantage of the knockout openings is to facilitate the on-site construction and installation of the kit.

Figure 13:
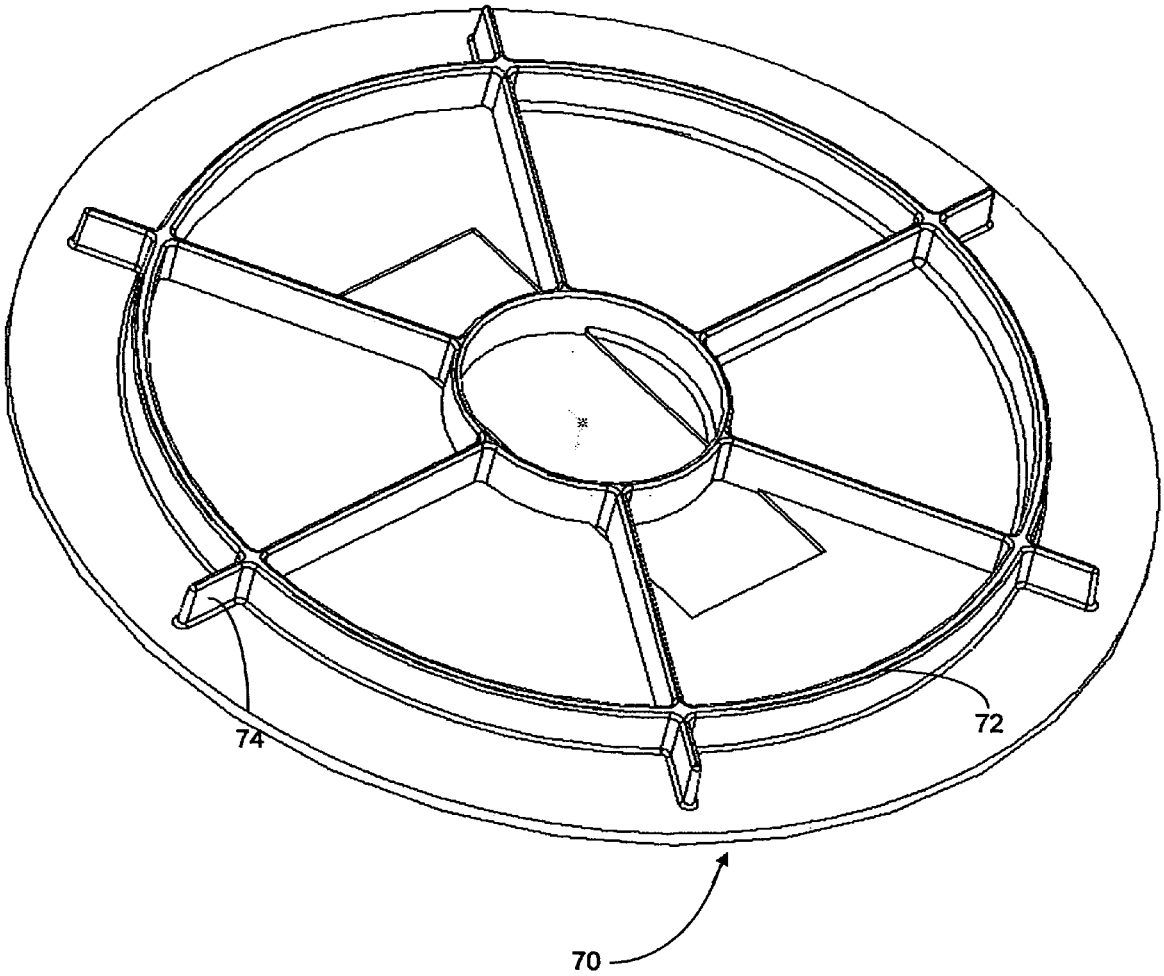
FIG. 13 is a perspective view of the bottom of a preferred embodiment of the lid.

The neck or upper portion 16 of chamber 10 defines an opening 60 including a lip 62 that is slightly larger in diameter than the upper portion 16. A lid 70 is disposed in the opening 60; lid 70 has a flat rigid circular portion and a downwardly depending ring 72 which is smaller in diameter than the inner diameter of lip 62. Spaced circumferentially around ring 72 as seen best in FIG. 13 is a plurality of radially oriented stiff structural ribs 74 the outer edges of which define a circumference that is substantially identical to the circumference of the inner wall of lip 62. The purpose of the ribs 74 is to provide structural stability to the opening 60. When the chamber 10 is installed in the aquifer, the forces of the surrounding aquifer material may distort the opening 60 from a near perfect circle due to the application of forces on the segment member walls, particularly the neck portion 16, and may result in a slightly elliptical shape of the opening 60. The result is that the lid, which is substantially circular, cannot be inserted within the lip opening 60 because of the differences in shape. Since it may be very difficult to reshape the opening 60 into a near perfect circle, the ribs 74 of the lid 70 may be trimmed so as to reduce the distance between opposing rib outer edges to a distance less than a perfect circle such that the outline of the radial outer edges of the ribs define an ellipse which will fit within the matching elliptical lip opening 60 and continue to maintain the opening against further distortion due to the pressure of the granular material of the aquifer bearing upon the exterior surface of upper portion 16.

It will be understood by those of ordinary skill in the art that other openings and engaging lid can be designed to effect a similar purpose as that described above, including a lip that is smaller than the diameter of the neck portion 16 and a lid with a larger diameter ring and inwardly radially directed ribs that may be trimmed in the manner described above. Other lid-opening configurations will be apparent to those having ordinary skill in the art to effect the structural stability of the chamber neck portion. The lid and opening may also include locking means to prevent accidental dislodging of the lid or tampering of the lid by a child seeking entry.

Figure 11:
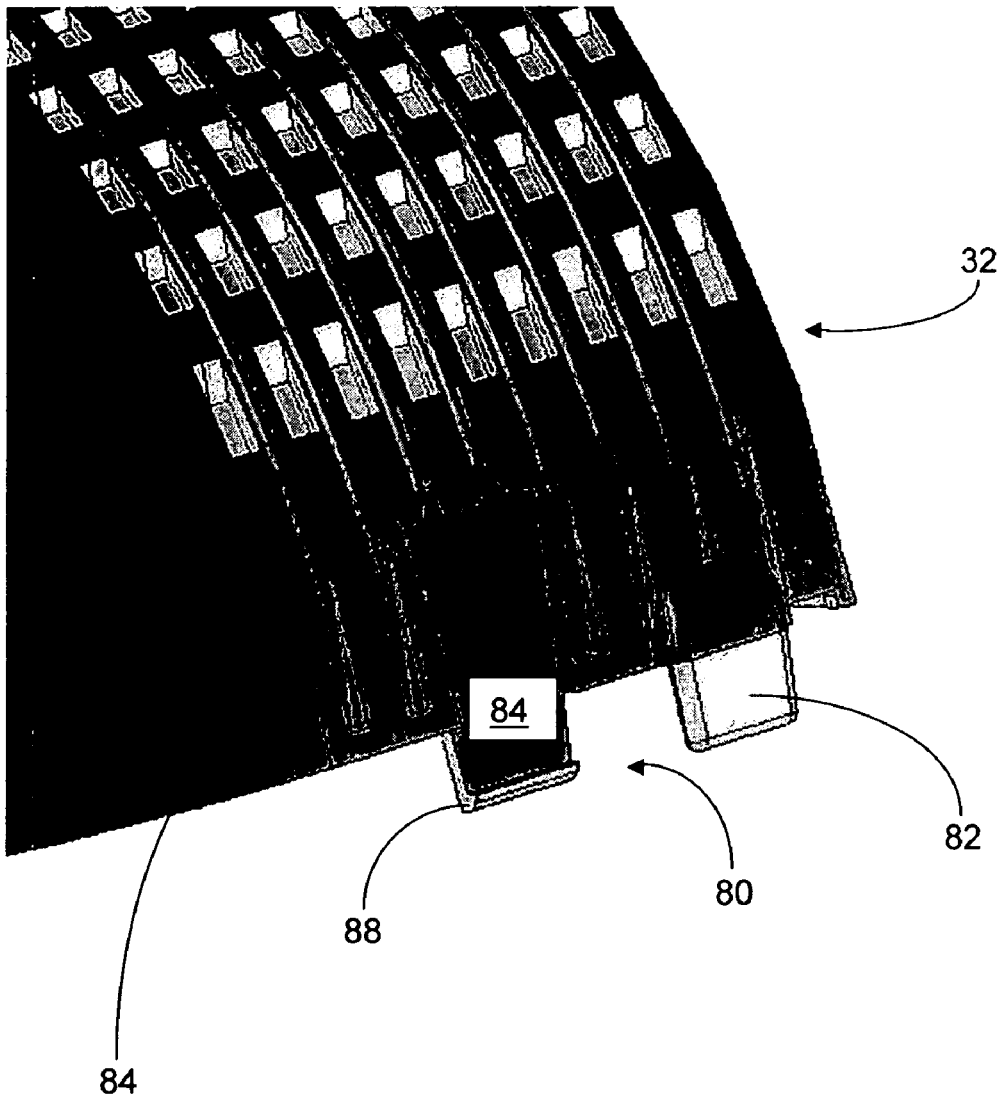
FIG. 11 is a detailed view of a preferred embodiment of a latch mechanism for joining two chamber members.
Figure 12:
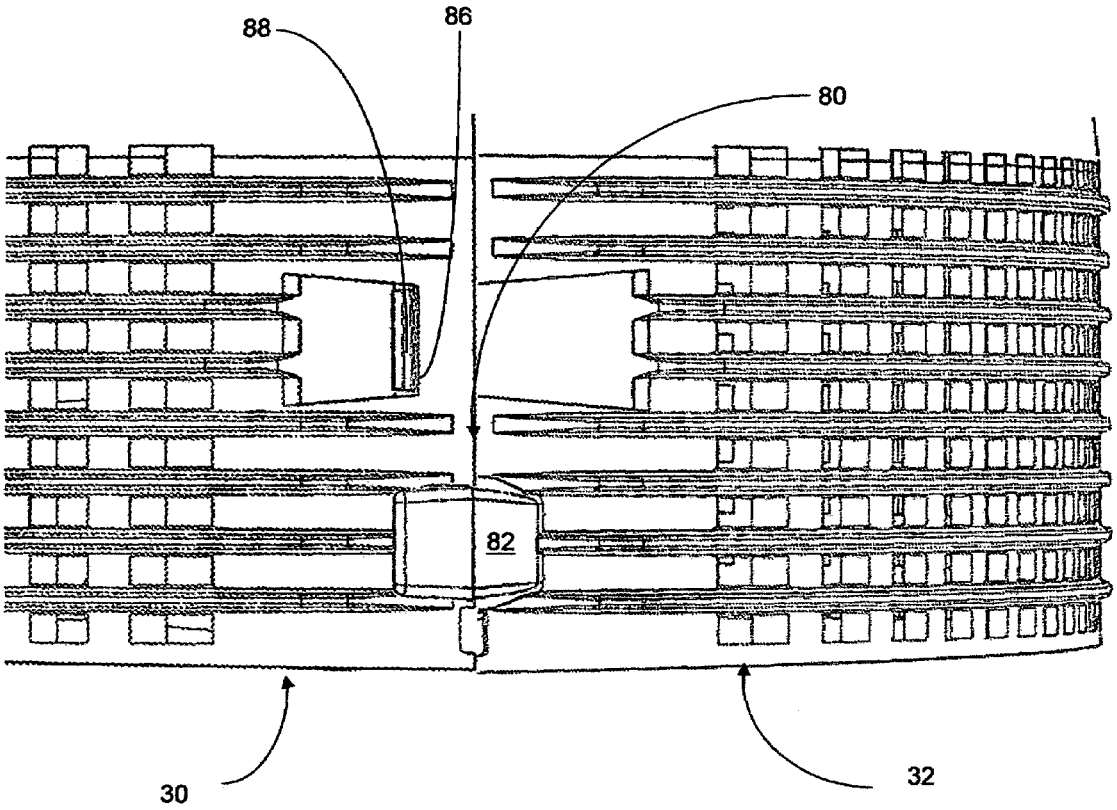
FIG. 12 is also a detailed view of the preferred embodiment of the latch mechanism shown when the chamber members are joined.

The adjoining vertical edges 22, 24 and 26, 28 of segment members 30, 32, respectively, are releaseably joined or secured by latch mechanisms 80 which in the preferred embodiment are located on upper portion 16 and lower portion 12 of chamber 10. Latch mechanisms 80 may take a wide variety of configurations well known to those of ordinary skill in the art. In the preferred embodiment where the walls of segment members 30 and 32 are plastic, a snap-fit, self-closing latch mechanism that is integral with the plastic walls has been found desirable. With attention drawn to FIGS. 11 and 12, it will be seen that the latch mechanism 80 comprises two members in the preferred embodiment, one of which is a stabilizing member 82 on segment member 32 and the other member comprises an arm 84 integral with segment member 32 and cooperating with a rectangular opening 86 on member 30 into which an enlarged or hook portion 88 of arm 84 will snap into. The arm 84 is radially inset from the wall of segment member 32 so that when the two longitudinal edges 22, 24 of members 30, 32 are brought together, arm or member 84 passes interiorly of segment member 30 while the latch stabilizing element 82 is radially outset from the wall of segment member 32 so as to pass on the exterior of the wall of segment member 30. In this manner, stabilizing member 82 provides resistance to outward expansion of the adjacent wall of segment member 30 thereby permitting hook portion 88 of arm 84 to be forcibly snap-fit into opening 86. The other latch mechanism 80 on the opposite side of neck portion 16 is a mirror image of the latch 80 that connects the longitudinal edges of segment members 30, 32. By mirror image, it is meant that latch members 80 and 84 are integral with segment member 30 on the opposite side to that shown in FIG. 10 and segment member 32 includes the opening 86 for receiving the hook portion 88 of latch arm 84. A similar pair of latch mechanisms 80 are located near the bottom edge of the lower portion 12 of adjoining segment members 30, 32. It will be understood that by creating mirror images of the latch mechanisms 80 on each side of segment members 30, 32 permits the segment members to be manufactured in the same mold. It will also be understood that through the provision of snap-fit latching means the chamber 10 may be easily assembled in the field by unskilled labor. The term "latch mechanism" is intended to cover any mechanism that will permanently or semi-permanently connect two separate objects including a strap that is cinched around the two objects, fasteners of various types, adhesive tapes, glue, clamps and other devices and materials known to those of ordinary skill in the art.

Figure 14:
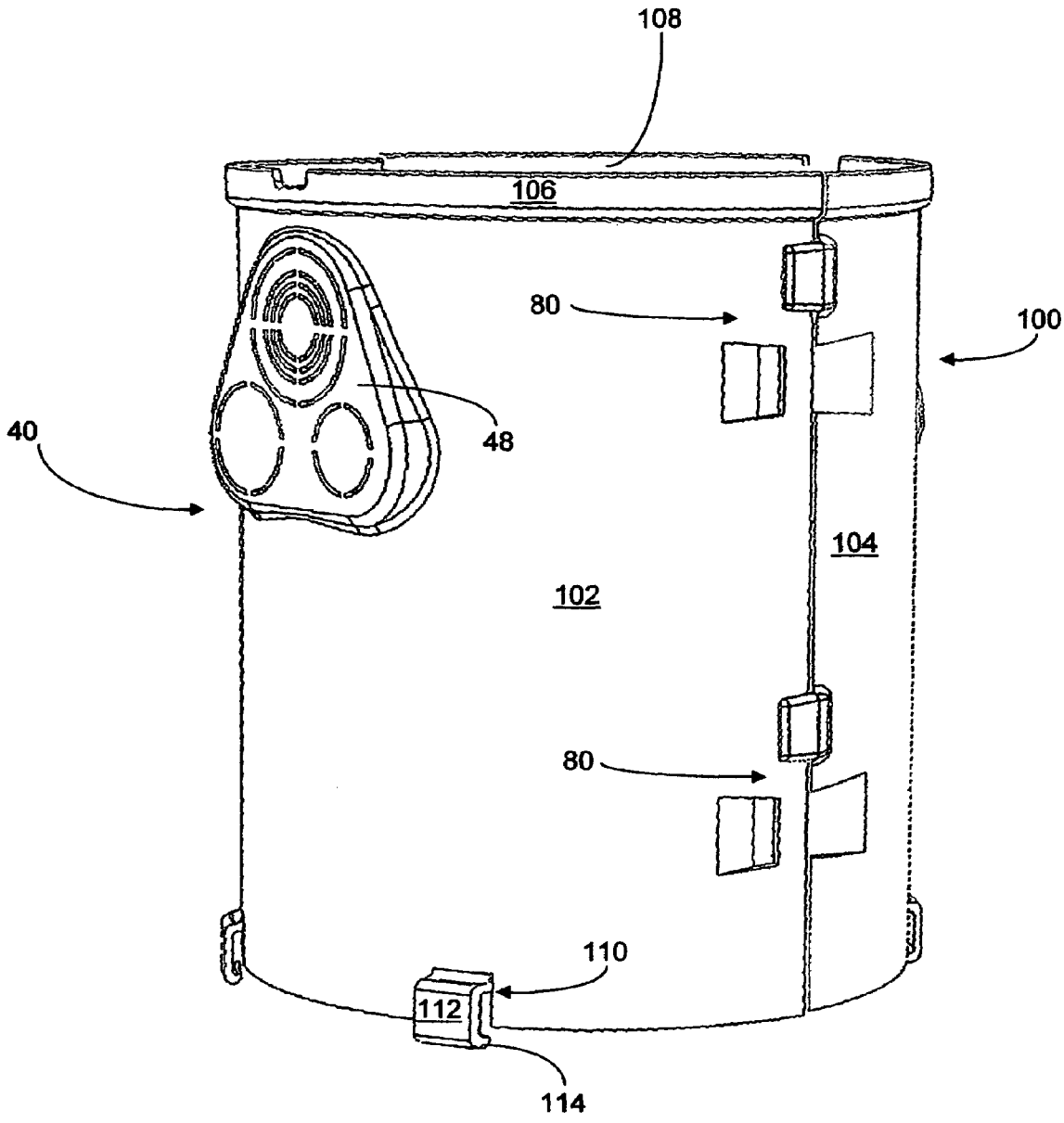
FIG. 14 is a perspective view of an assembled chamber extension.
Figure 15:
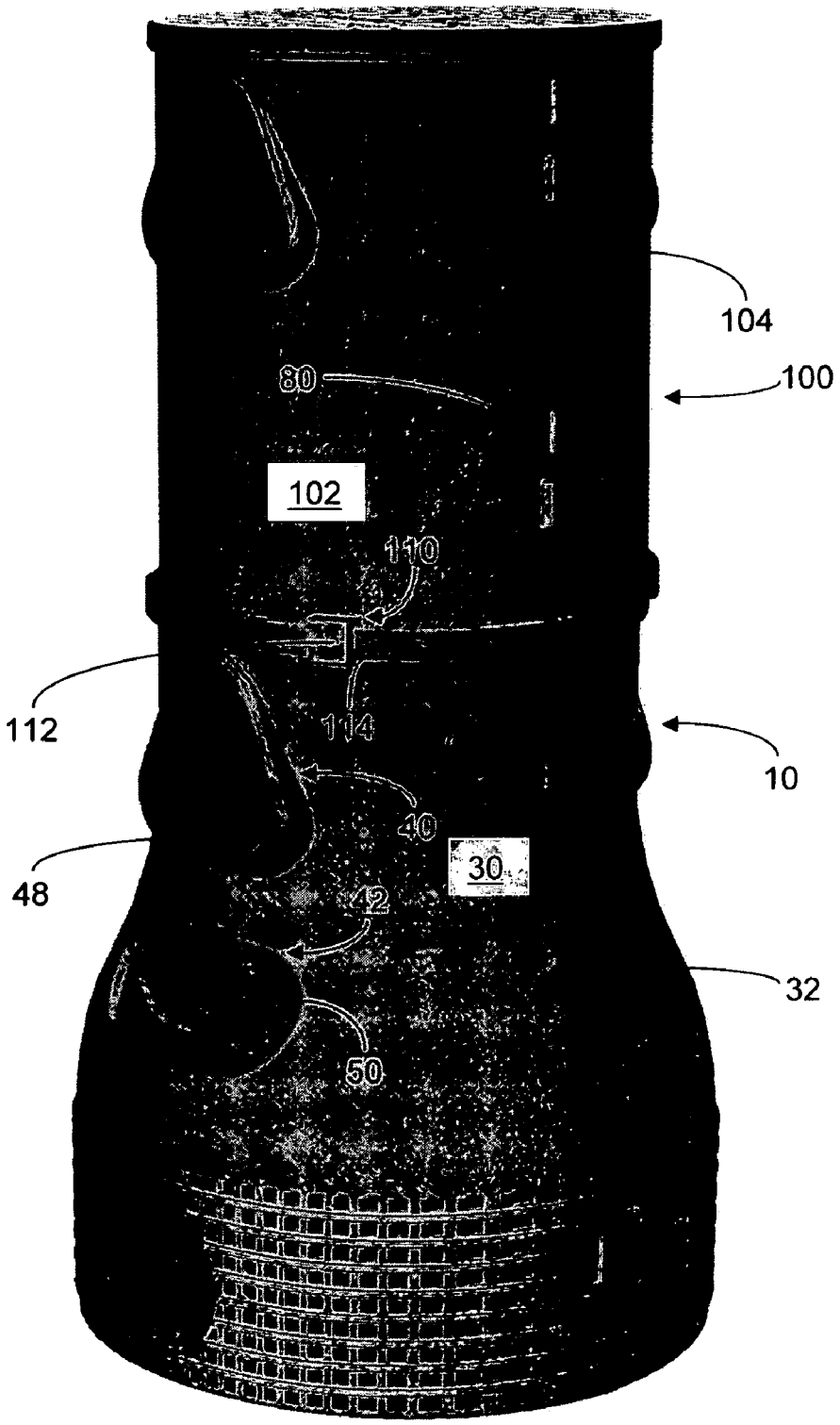
FIG. 15 is a perspective view of the extension and chamber shown assembled.

In certain applications, it may be desirable to provide a reservoir or chamber with larger water capacity. This requirement is met in the present embodiment of the invention by the addition of an extension chamber 100 shown in FIGS. 1 and 14-16. With reference to FIG. 14, it will be seen that the extension chamber 100, like the main chamber, may comprise two or more arcuate segments or sections; in the preferred embodiment, chamber 100 has two semi-cylindrical segments or members 102 and 104 which together define the cylindrical chamber extension 100. As described with reference to the chamber 10, the two semi-cylindrical segments of the extension chamber 100 may be secured to one another by snap-fit latch mechanism 80 at upper and lower locations along the longitudinal edges of the segment members 102, 104. FIG. 14 also shows that there are knock-out openings in the upper portion of extension member 100 which may be identical to the knock-out openings 40 on faceplate 48 on chamber 10. Extension chamber 100 also has a lip 106 that defines a top opening 108 as in chamber 100. At the bottom end of extension member 100, there is provided a plurality of releasable locking mechanisms 110 which are similar to the latching means 80 in that they are formed integral with the segment members 102, 104. The locking mechanisms 110 comprises a tab 112 that is radially proud of the curved plane of the segment member and is attached to the segment member wall at one end, while the opposite end includes a hook-shaped portion 114. As seen best in FIG. 15, the locking mechanism 110 of extension member 102 will snap-fit over the lip 62 of chamber 10 so that the tab 112 passes over the lip 62 and is biased inwardly so that the hook portion 114 engages the lower shoulder of lip 62 to effect the locking action. The number of locking mechanisms 110 that are circumferentially disposed around the bottom of extension chamber 100 will be easily determined by those having ordinary skill in the art. It will also be understood that the locking mechanisms 110 are simply exemplary of the type of device that may be used to join the extension chamber 100 to chamber 10.

Figure 16:
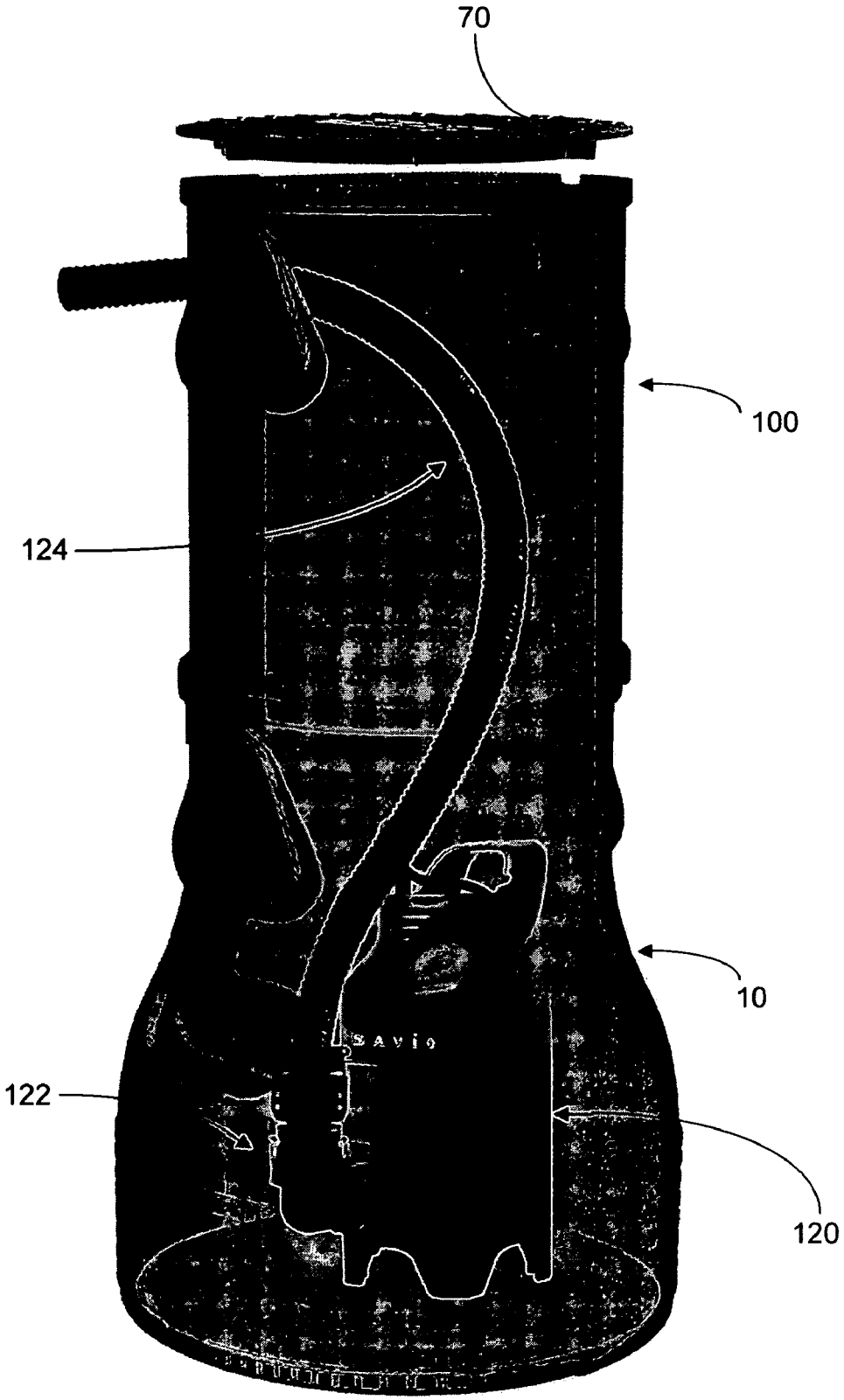
FIG. 16 is a phantom view showing a pump mounted in the chamber and exiting through a knockout in the extension chamber.

FIG. 16 is a phantom perspective view of the extension chamber 100 mounted on chamber 10 and including another component or sub-assembly of the kit, a water pump 120. Water pump 120 is conventional and well known to those having ordinary skill in the art. The pump inlet (not shown) draws water from within the chamber 10 and discharges the water through an outlet fitting 122 which is attached to a flexible hose 124 that extends upwardly into extension chamber 100. As described above, one of the openings in knockout openings 40 has been punched out so that the free end of flexible hose 124 will pass through the knock-out opening and may be attached to, for example, a waterfall, such that the water collected in chamber 10 is discharged into the waterfall box where it will flow into the water feature. Hose 124 is of typical construction and other types of tubes, pipes, hoses, and other longitudinally extending water-carrying devices may be substituted as will be understood by those of ordinary skill in the art.

Figure 17:
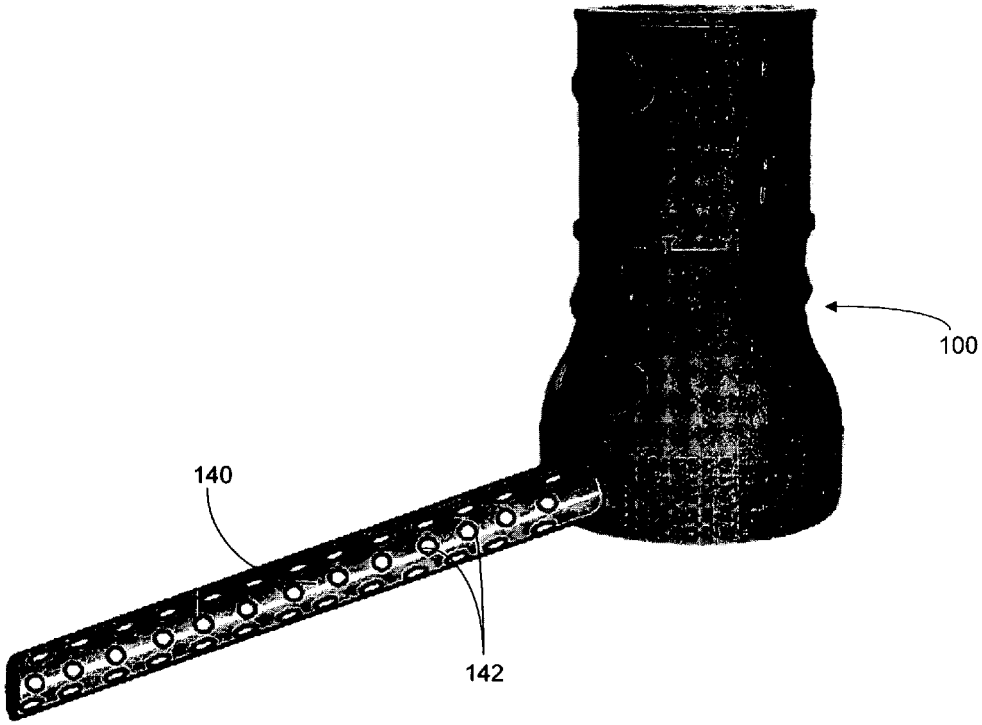
FIG. 17 is a perspective view of a horizontal distribution pipe connected to the chamber shown in FIG. 15.

FIG. 17 shows a distribution pipe 140 with a plurality of small openings 142; the pipe is connected to one of the knock out openings 52 in the body portion 12 of chamber 10.

As seen best in FIG. 3, the segment members 30, 32 may include a bottom wall 130 which is integral with the side walls forming the lower portion 12 of each segment. It may be desirable to include such bottom wall particularly where a pump is a part of the water reservoir system. Moreover, the bottom wall provides structural stability to the segments 30, 32 and to the chamber 10 when completely assembled. However, it should be understood that the present invention does not require a bottom wall in which event the lower circumferential edge of chamber 10 will rest directly on the granular material of the aquifer.

The kit of the present invention includes an assemblage for installation at a site including the housing members 30, 32 as well as a lid 70 which forms the basic components of the kit. Depending upon the application, the assemblage may include the pump 120, hose 124, and/or other pipes, tubes or hoses as may be suitable for the particular application of the water chamber.

While the invention has been shown and described with reference to a preferred embodiment thereof, it will be understood by those skilled in the art that various changes in form and detail may be made in such embodiment without departing from the spirit, scope and teachings of the invention. Accordingly, the invention disclosed herein is to be limited only as specified in the following claims.

What is claimed is:

1. A plastic water reservoir kit for use in water conservation for installation in an aquifer consisting of granular material comprising:

a generally cylindrical chamber comprising at least two plastic arcuate segment members each including upper and lower portions, said members nested in one another during shipment so as to reduce the overall size of the chamber and being field assembled on-site into said chamber, said upper portion of said chamber defining a top opening, at least one of said arcuate segments having at least one knockout for selectively creating openings in said chamber, said arcuate segment members including integral plastic latch mechanisms for securing said segment members together;

each arcuate segment member formed from a water impermeable wall having vertical edges for mating with another arcuate segment member;

a lid for closing said top opening;

said chamber having a water permeable portion for permitting water to flow out of said chamber and preventing aquifer granular material from entering through or clogging the flow, whereby water is collected in said chamber for subsequent controlled distribution.

2. The water reservoir kit of claim 1 wherein said arcuate segment members are generally semi-cylindrical.

3. The water reservoir kit of claim 1 wherein said upper and lower portions are cylindrical, and an intermediate portion generally frusto-conical in shape.

4. The water reservoir kit of claim 1 additionally including a pump.

5. The chamber of claim 4 wherein said pump is located in the lower portion of said chamber and additionally comprising at least one tube passing through a wall of one of said segment members for delivering water in said chamber to a second location.

6. The water reservoir kit of claim 1 additionally including a generally cylindrical extension chamber engaging the upper edge of said chamber.

7. The chamber of claim 6 additionally including means for locking said extension chamber to said chamber.

8. The chamber of claim 1 wherein at least one of said knockout openings receives a drain pipe for distributively discharging water from said chamber into the aquifer.

9. The chamber of claim 8 wherein said knockouts are of variable size.

10. The chamber of claim 1 wherein upper edges of said chamber segment members define a substantially circular lip comprised of rigid material, said lid when fitted within said lip maintaining said top opening against distortion.

11. The chamber of claim 1 wherein at least one of said latch mechanisms comprises:

an arm formed from plastic material attached at one end to one of said segment members and defining a hook-like element on the free end, said arm extending circumferentially beyond the vertical edge of said segment member, and the adjoining segment member having an opening for receiving the hook-like element so as to secure the two adjoining segment members together.

12. The chamber of claim 11 wherein at least one of said latch mechanisms comprises a stabilizing member adjacent said arm that extends circumferentially beyond the vertical edge of one of said segment members to provide radial strength to the adjoining segment member wall when said arm hook-like element is engaged with said opening.

13. The chamber of claim 1 wherein said lower portion includes a plurality of circumferentially extending ribs adjacent said openings to provide structural stability to said chamber.

14. The chamber of claim 1 additionally including a bottom wall formed integral with the lower portion of said chamber member wall.

15. The chamber of claim 1 wherein said chamber additionally includes a generally cylindrical extension chamber engaging the upper edge of said chamber, said extension chamber comprising at least two semi-cylindrical members, each member comprised of a water impermeable wall including vertical edges for mating with another semi-cylindrical member.

16. A plastic chamber for collecting water, said chamber positioned in a cavity within an aquifer comprising granular material, such as gravel of a selected minimum size, the chamber comprising:

a plastic housing having a shape like the upper portion of a bottle, including a neck portion, shoulder portion and cylindrical portion, the neck portion having a top opening, the bottle-shaped housing being vertically split and comprising two mating halves at least one said mating halves including at least one knockout for selectively creating openings in said chamber, said mating halves including integral plastic latch mechanisms for securing said mating halves together;

a lid for said top opening; and said cylindrical portion having openings smaller than the minimum size of the granular material of said aquifer to permit water within said chamber to flow out of said chamber in a controlled manner but preventing the granular material from entering said chamber.

* * * * *